US005417359A

United States Patent [19]

Zellner

[11] Patent Number: 5,417,359

[45] Date of Patent: May 23, 1995

[54] TABLET SPLITTING CARD

[76] Inventor: Jonathan P. Zellner, 6439 Ox Rd., Fairfax Station, Va. 22039

[21] Appl. No.: 232,465

[22] Filed: Apr. 22, 1994

Related U.S. Application Data

[63] Continuation of Ser. No. 130,145, Sep. 17, 1993, abandoned, which is a continuation of Ser. No. 941,257, Sep. 4, 1992, abandoned.

[51] Int. Cl.[6] ..... B26F 3/00

[52] U.S. Cl. ..... 225/93; 225/91

[58] Field of Search ..... 225/93, 96.5, 91, 103; 283/904

[56] References Cited

U.S. PATENT DOCUMENTS

| | | | |
|---|---|---|---|
| 3,517,871 | 6/1970 | Gaffney | 225/103 |
| 3,650,445 | 3/1972 | Heitzman | 225/93 |
| 3,815,802 | 6/1974 | Stevens | 225/93 |
| 4,173,826 | 11/1979 | Leopoldi | 30/124 |
| 4,179,806 | 12/1979 | Lieptz | 30/124 |
| 4,199,863 | 4/1980 | Deckert | 30/124 |
| 4,330,936 | 2/1981 | Swarth | 30/124 |
| 4,422,553 | 12/1983 | Hoeks | 206/528 |
| 4,473,192 | 9/1984 | Urban | 241/168 |
| 4,507,346 | 3/1985 | Maurer et al. | 283/904 |
| 4,597,593 | 7/1986 | Maurer | 283/904 |
| 4,672,891 | 6/1987 | Maurer et al. | 283/904 |
| 4,697,344 | 10/1987 | Leopoldi | 30/124 |
| 4,903,877 | 2/1990 | Hnatuk | 225/93 |
| 4,964,555 | 10/1990 | Hnatuk | 225/93 |
| 5,123,320 | 6/1992 | Hochfeld | 225/93 X |

*Primary Examiner*—Kenneth E. Peterson
*Attorney, Agent, or Firm*—Gary Steven Pisner

[57] ABSTRACT

An apparatus for splitting medicinal tablets which consists of a ridge 12 fused onto or stamped into the surface of card shaped materials. The card 14 can be made of any material with sufficient hardness to permit use of the ridge 12 as a fulcrum to fracture the tablet.

A tablet is split using a tablet splitting card by placing a tablet 18 on the ridge 12. Pressure is then applied to the edges of the tablet with two fingers 20. The tablet will split along a line corresponding to the position of the ridge on the card.

8 Claims, 3 Drawing Sheets

TABLET SPLITTING CARD

This is a continuation of a prior U.S. application Ser. No. 08/130,145, filed Sep. 17, 1993, now abandoned, which is a continuation of U.S. Ser. No. 07/941,257, filed Sep. 4, 1992, now abandoned.

FIELD OF THE INVENTION

This invention relates to a card size apparatus designed to help one break a medicinal tablet into smaller parts.

BACKGROUND OF RELATED ART

The size and active ingredient content of a medicinal tablet are based on economic necessities and on epidemiological projections. In most instances, one can take a given number of medicinal tablets over a given period of time to receive the proper dosage of medication. There are, however, occasions when the proper dosage of a medication can be administered only by ingesting a fragment of a medicinal tablet. To get this fragment of a medicinal tablet of the correct size, one must accurately break a tablet into correctly sized parts. Breaking a tablet incorrectly may result in wastage, crumbling, or undesirable damage to a tablet coating. Because of these problems, there is a need for a device that will help a patient or physician split a tablet into parts.

A number of devices are designed to help one accurately split a tablet into parts. Some of these devices use a mounted blade in combination with a means for fixing the position of the tablet relative to the blade. Other devices use a ridge mounted on a base as a fulcrum to split a tablet into pans. The use of a ridge mounted on a base can be found in a number of devices including: U.S. Pat. Nos. 3,815,802 of Stevens 1972, and 4,964,555 of Hnatuk 1990 where the ridge is mounted inside the lid of a tablet container, or U.S. Pat. No. 3,650,445 of Mechlin 1972 where the ridge is mounted to a modified base of a tablet container. The problem with these devices is that they are part of the medication container. If one must carry a small number of medicinal tablets, one must carry a bulky lid to split the medication when needed. Also, one cannot generally reuse a cap mounted tablet splitter. Medication containers come in many sizes. If one wishes to reuse the cap mounted tablet splitter, one must have a new medication container that has the same lip dimensions as the original container with the cap mounted tablet splitter.

It is the object of this invention to create a simple one piece device for splitting tablets which, unlike the above inventions, can be unobtrusively placed in a wallet, purse or pocket. That object is accomplished by attaching or stamping out a ridge on the surface of a card. Unlike prior inventions, one does not have to carry a tablet container to carry a tablet splitter. The tablet breaking card is compact; accordingly, one can store the card in a pocket, wallet, purse, or envelope. Additionally, the present invention consists of a single pan, whereas other tablet splitters consist of multiple parts that make the tablet splitter bulky, difficult to manufacture, and easy to break (see U.S. Pat. No. 4,173,826 of Leopoldi 1979).

DESCRIPTION OF THE PREFERRED EMBODIMENTS

Figure 1A:
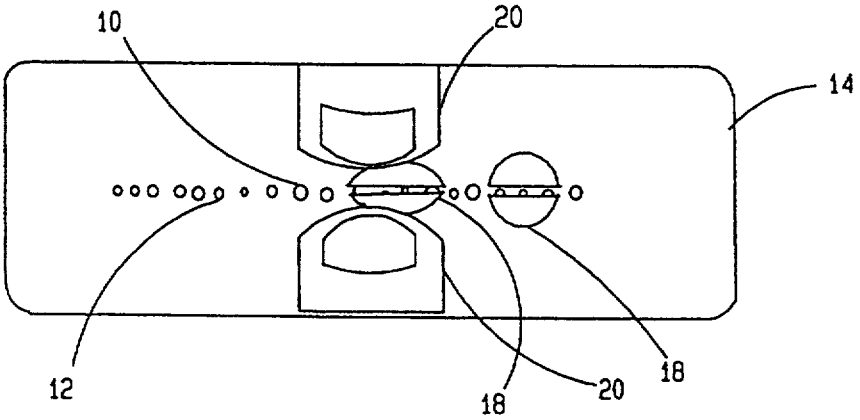
FIG. 1 A is a top view of one embodiment of the tablet splitting card with a ridge formed by a line of raised perforations on the surface of the card.
FIG. 1B is a top view of one embodiment of the tablet splitting card with a continuous ridge.
Figure 1B:
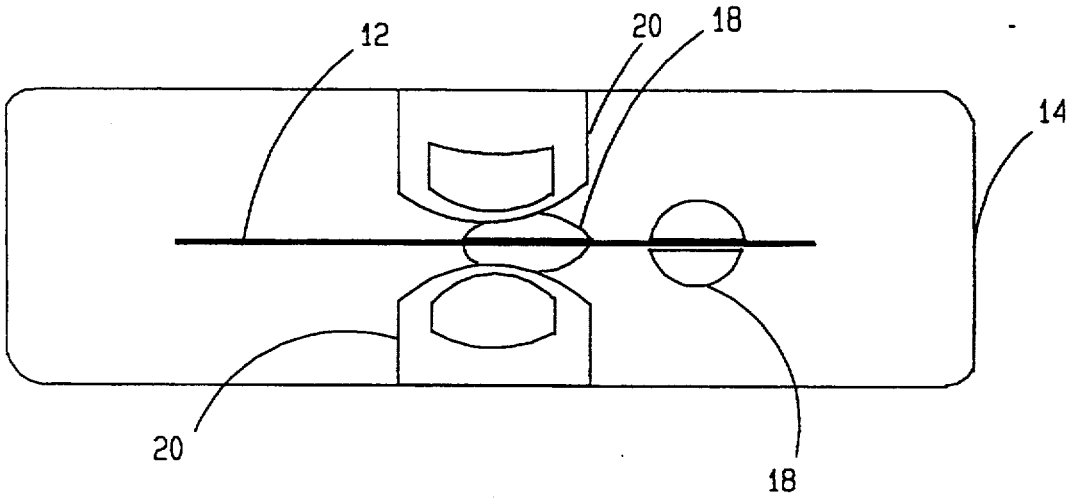
Figure 2:
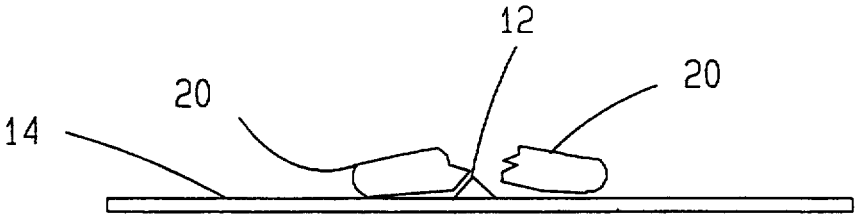
FIG. 2 is a cross-sectional view of the tablet splitting card.

FIG. 1*a* displays one embodiment of this invention. This apparatus consists of a card 14 with a series of raised surfaces 10 forming a ridge 12. The series of raised surfaces can be stamped into the card 14 or fused onto the surface of the card 14. FIG. 1*b* is an embodiment that uses a ridge 12 formed by stamping a continuous ridge 12 into the card 14 or fusing a continuous ridge 12 onto the surface of the card. A cross-section of the card 14 and the ridge 12 can be found in FIG. 2. The card 14 can be made of any material with sufficient hardness to permit use of the ridge 12 as a fulcrum to fracture the tablet. Plastic is the most desirable material for the tablet splitting card. There are a number of plastics that have sufficient hardness for splitting tablets, but that are flexible enough to be carried in a wallet without being damaged. Also plastic has the added advantage of allowing one to print advertisements, instructions, or tablet aligning guides on the surface of the card.

A tablet is split using a tablet splitting card by placing a tablet 18 on the ridge 12. Pressure is then applied to the edges of the tablet with two fingers 20. The tablet will split along a line corresponding to the position of the ridge on the card.

Accordingly, the tablet splitting card is an effective, simple, and compact apparatus for splitting a tablet.

Although the description above contains many specificities, it should not be construed as limiting the scope of the invention, but as merely providing illustrations of some of the presently preferred embodiments of this invention. For example, the card 14 can have almost any shape. It can be made of plastic, metal, ceramic or any material with sufficient hardness. The raised surfaces 10 can be circular or ovoid.

Thus, the scope of the invention should be determined by the appended claims and their legal equivalents, rather than by the examples given.

I claim:

1. A tablet splitting card, comprising:

(a) a single flat one piece non circular card;

(b) a ridge projecting from a surface of said single flat one piece card; and whereby a tablet can be split into pans by placing a tablet over said ridge, and applying pressure to edges of the tablet at two opposing points.

2. The tablet splitting card of claim 1 wherein said ridge projecting from the surface of said non circular card is formed from a plurality of raised surfaces.

3. The tablet splitting card of claim 1 wherein said ridge projecting from the surface of said non circular card is formed as a single continuous ridge.

4. The tablet splitting card of claim 1 wherein said non circular card is made of plastic.

5. A tablet splitting card, comprising:

(a) a single fiat one piece card with at least four sides;

(b) a ridge projecting from a surface of said single fiat one piece card; and whereby a tablet can be split into pans by placing a tablet over said ridge, and applying pressure to edges of the tablet at two opposing points.

6. The tablet splitting card of claim 5 wherein said ridge projecting from the surface of said card having at least four sides is formed from a plurality of raised surfaces.

7. The tablet splitting card of claim 5 wherein said ridge projecting from the surface of said card with at least four sides is formed as a single continuous ridge.

8. The tablet splitting card of claim 5 wherein said non circular card is made of plastic.

* * * * *